US005580097A

United States Patent [19]

Latvakangas et al.

[11] Patent Number: 5,580,097

[45] Date of Patent: Dec. 3, 1996

[54] COVER AND METHOD AND DEVICE FOR MANUFACTURING THE SAME

[75] Inventors: Urpo Latvakangas, Saltsjo-Boo; Jan Sabelstrom, Huddlinge, both of Sweden

[73] Assignee: Bindomatic AB, Stockholm, Sweden

[21] Appl. No.: 224,752

[22] Filed: Apr. 8, 1994

[30] Foreign Application Priority Data

Aug. 31, 1993 [SE] Sweden ..... 9302811

[51] Int. Cl.[6] ..... B42C 7/00

[52] U.S. Cl. ..... 281/29; 281/21.1; 412/4; 412/19; 412/29

[58] Field of Search ..... 412/3, 4–6, 8, 412/17, 1, 9, 22, 29, 19, 900; 281/21.1, 29, 35–37, 15.1; 156/908

[56] References Cited

U.S. PATENT DOCUMENTS 4,091,487 5/1978 Axelrod ..... 412/19 X
5,062,754 11/1991 Bolin et al. ..... 281/21.1 X
5,330,229 7/1994 Zoltner ..... 412/19 X

*Primary Examiner*—Frances Han
*Attorney, Agent, or Firm*—Cooper & Dunham LLP

[57] ABSTRACT

A cover comprising a spine (3), a strip of binding agent (4) connected to the spine, and two cover sides 1, 2) which are connected with the spine by means of a first pair of creasing lines (5, 6) extending parallel to the strip, the cover sides also being provided with a second pair of of creasing lines (7, 8) extending parallel to the strip, which creasing lines are at at short distance from the first pair and along which the cover sides are folded on opening and closing of the booklet, a sheaf of papers (20) being intended to be inserted into the cover with one side edge of the same in contact with the strip, such that on melting and subsequent cooling of the strip, the sheaf of papers will be connected to the spine to form a finished booklet. The second pair of creasing lines are deformed in such a way that when the cover sides of the cover are essentially parallel, the two portions (9, 10) between the two pairs of creasing lines exert an inwardly directed pressure against the not yet melted strip. The invention also relates to a method and a device for manufacturing the cover.

13 Claims, 3 Drawing Sheets

COVER AND METHOD AND DEVICE FOR MANUFACTURING THE SAME

TECHNICAL FIELD

The present invention relates to a cover, a method and a device for manufacturing the same.

The cover comprises a spine, a strip of binding agent connected to the spine, and two cover sides which are connected with the spine by means of a pair of creasing lines extending parallel to the strip, the cover sides also being provided with a second pair of creasing lines extending parallel to the strip, which creasing lines are at a short distance from the first pair and along which the cover sides are folded on opening and closing of the cover, a sheaf of papers being intended to be inserted into the cover with one side edge of the sheaf in contact with the strip, such that on melting and subsequent cooling of the strip, the sheaf of papers will be connected to the spine to form a finished booklet.

BACKGROUND ART

Covers of the above-described kind are previously known in a variety of configurations. Examples of such configurations are found in SE-B 452 287. In FIG. 4 in said document it is shown that each of the two portions between the creasing lines 5 and 7 and 6 and 8, respectively, make an obtuse angle with the spine 3 such as to form a gap between said portions and the strip of binding agent 4. If a sheaf of papers is inserted between the substantially parallel cover sides into contact with the strip, the outermost sheets of papers in the sheaf will fall down into the gaps between the strip and the two portions, wherefore the outermost sheets of paper in the sheaf will not contact the strip and will therefore not be connected to the cover on subsequent activation of the strip.

In order to eliminate this disadvantage, the longitudinal side edges of the strip may be connected to said portions before the sheaf of papers is inserted in the cover. This is shown in FIGS. 1 and 2 in the above-mentioned patent specification.

Said measure brings a solution to the problem encountered and implies an increase in the quality of the cover and therefore of the finished booklet, however, also increased costs of manufacturing the cover.

SUMMARY OF THE INVENTION

It is an object of the present invention to eliminate, at least partly, the disadvantages of the previously known covers of the above-described kind and to achieve a cover and a method for manufacturing the same providing a cover and therefore a booklet of high quality at a low cost.

This object is achieved by the cover, the method and the device according to the invention having been given the features stated in the characterizing portions of the claims.

PREFERRED EMBODIMENT

Figure 1:
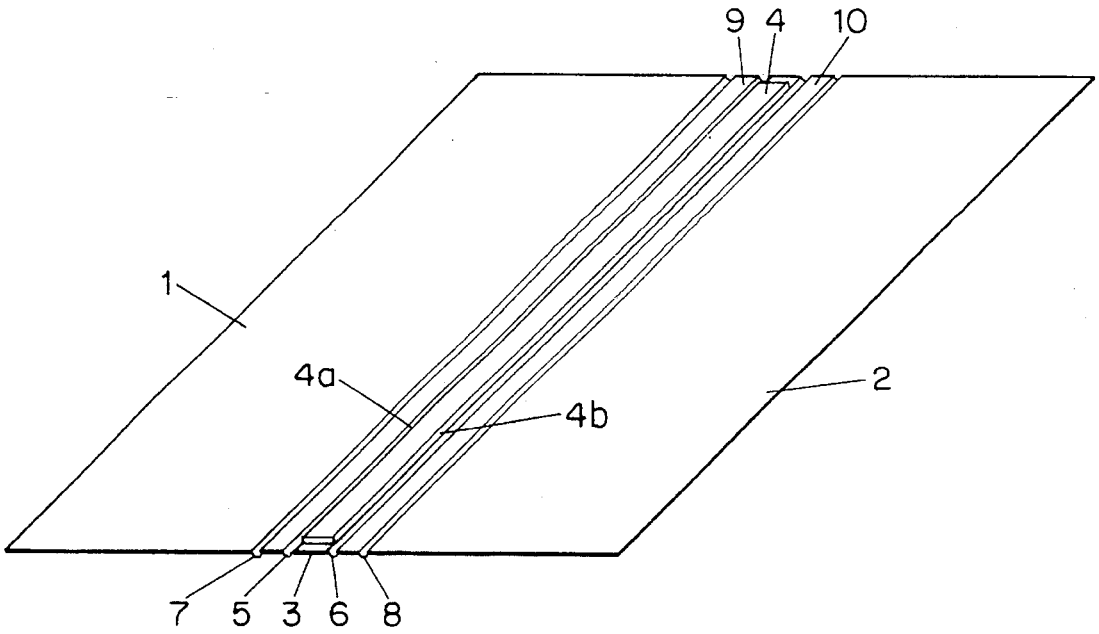
FIG. 1 is a perspective view showing a cover prior to treatment according to the method of the present invention.

In FIG. 1 there is depicted a conventional cover provided with two cover sides 1 and 2 and a spine 3, which may be formed in one piece of, for instance, cardboard or as separate sheets of cardboard and/or plastic, which are interconnected in some suitable manner. The binding agent consists of, for instance, thermoplastic, melt glue or the like, which at room temperature is in a solid state and which, when heated to a certain temperature, will melt and become more or less fluid. The strip of glue 4 has a rectangular cross section and its two opposing, longitudinal side edges 4*a* and 4*b*, which are substantially perpendicular to the spine 3, are situated immediately inside an inner pair of creasing lines 5 and 6 between the spine and the cover sides 1 and 2. The creasing lines 5 and 6 are suitably provided by creasing in connection with the strip 4 being attached to the inside of the spine and another pair of creasing lines 7 and 8 being formed at a short distance from the lines 5 and 6. The two strip-shaped portions between the creasing lines 5 and 7 and 6 and 8 respectively are indicated at 9 and 10 respectively.

A method and a device for providing said creasing lines 5–8 and the attachment of the strip 4 are shown in U.S. Pat. No. 4,367 061, whereby is obtained that the strip is accurately oriented between the lines 5 and 6, such that the subsequent folding can take place without the strip interfering and without deformation of the portions 9 and 10.

Figure 2:
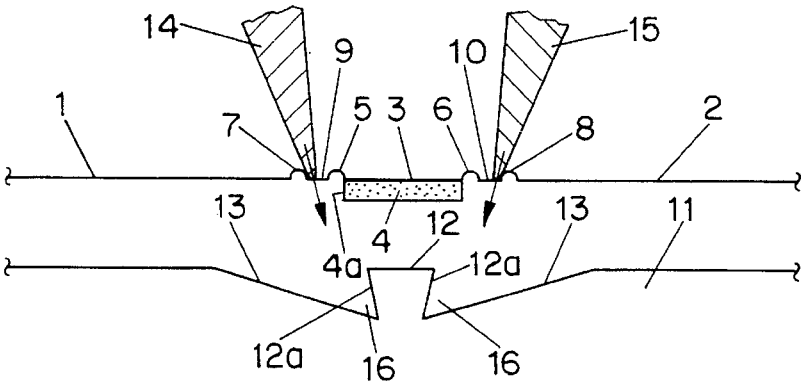
FIGS. 2–4 are schematic views, partly in section, of a device for manufacturing the cover according to the invention.

The folding of the conventional cover shown in FIG. 1 will now be described with reference to FIGS. 2–4. Said FIGURES show that the cover of FIG. 1 is kept above a matrix 11 provided with a central trapezoidal elevation 12 having two lateral surfaces 12*a*, which are inclined relative to the upper surface of the elevation, as well as connecting inclined surfaces 13. During the folding operation, two pointed wedge-shaped elements 14 and 15 bearing against the two portions 9 and 10 and having the same length as the creasing lines 5–8, will move the central portion of the cover downwards in FIG. 2 until the strip 4 is brought to bear against the elevation 12. On continued displacement downwards-inwards of the elements 14 and 15 the portions 9 and 10 will be folded downwards along the creasing lines 5 and 6 and 7 and 8, so that each portion will make an acute angle of approximately 30°–90°, preferably around 750°, with the spine 3 and an about equal acute angle with the cover sides 1 and 2 respectively. The outer creasing lines 7 and 8, which are convex in the direction from the strip 4 when the cover is planar as in FIGS. 1 and 2, are deformed by said folding and by the elements 14, 15 pressing the creasing lines against the adjacent surfaces 12*a* and 13, which surfaces form recesses 16 in the form of inner corners of acute angle. By heating the pointed edges of the elements 14, 15 and/or the corner area formed by the surfaces 12*a* and 13, and thereby heating the creasing lines 7 and 8, when the elements assume the positions shown in FIG. 3, folding/deformation is facilitated and further it is achieved that the cover sides 1, 2, after folding is finished and the cover has been removed from the device 11–13, tend to be pivoted more slowly from the portions 9, 10 than would have been the case without heating.

If the material, in which the creasing lines 7 and 8 are made, consists of cardboard, said deformation implies that the fibres in the cardboard material will break and/or bend. If the cardboard material is heated at the same time as it is being folded, the binding agent therein will also be affected such that the deformation will be more lasting than it would have been without heating.

Figure 3:
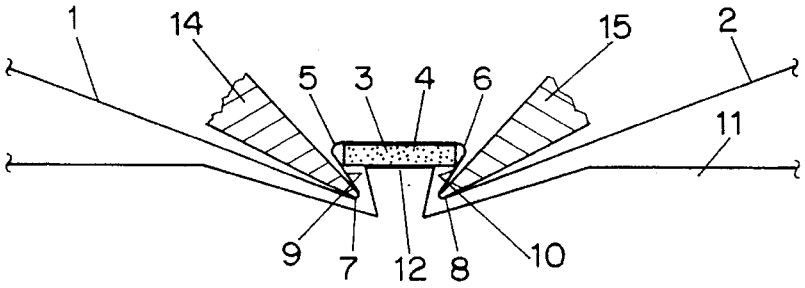
Figure 4:
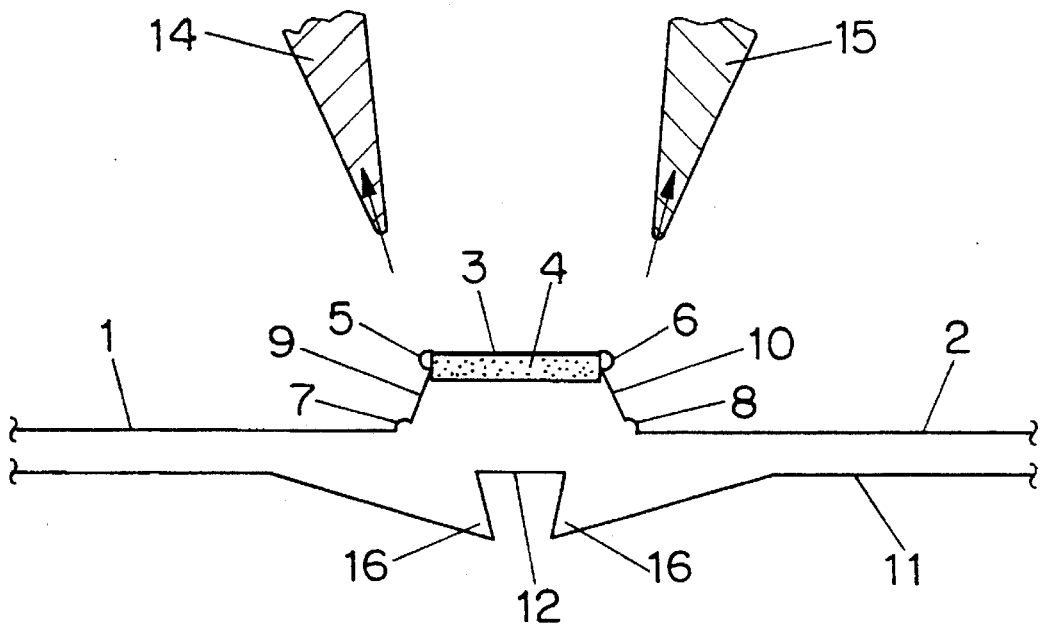

When the elements 14, 15 have been held in the positions shown in FIG. 3 during a predetermined period of time they will be moved from the cover 1–10 and the device 11–13 to their positions shown in FIG. 4. After this measure, the cover 1–10 will have approximately the shape shown in FIG. 4, i.e. with the portions 9 and 10 forming obtuse angles with the spine 3 and the cover sides 1 and 2, respectively.

Figure 5:
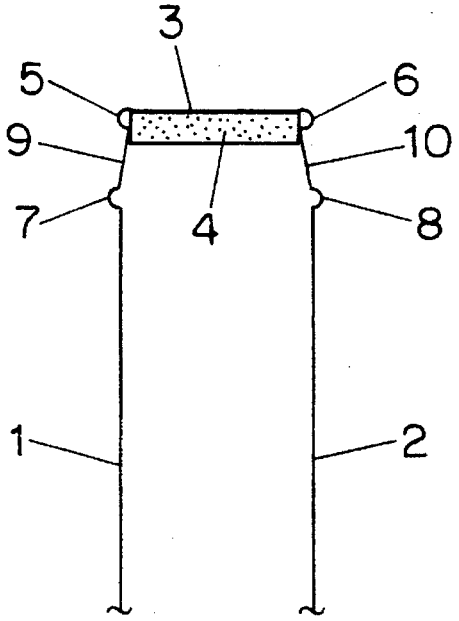
FIG. 5 is a schematic sectional view of the cover according to the invention.

FIG. 5 shows the appearance of the cover 1–10 after folding the cover sides 1, 2 towards each other to substantially parallel positions in which they are held by the action of forces acting on the outsides of the cover sides. During said folding, which is done manually, the portions 9, 10 are pivoted somewhat against the side edges 4*a*, 4*b* of the strip 4 around the creasing lines 5, 6 and are brought to bear against said side edges, and the cover sides 1, 2 are pivoted around the creasing lines 7 and 8. During the above-described folding, the force tending to pivot the cover sides 1, 2 from each other around the creasing lines 7, 8 and which was created in connection with the folding operation shown in FIG. 3 is indeed reduced, but the remaining force is sufficient for the cover sides 1, 2 to be pivoted from each other if they are not kept in the positions shown in FIG. 5.

In approximately the shape shown in FIG. 5, the cover 1–10 is brought together with a plurality of identical covers by inserting them into each other with the inside of the strip 4 of a cover located immediately adjacent the outside of the spine 3 of a cover inserted in the first-mentioned cover. The stack of covers is then inserted into a package which is transported to the end user. During the period of time between the forming of the covers 1–10 by means of the device 11–13 and the use of the covers for binding purposes, the force remaining in the creasing lines 7, 8 and tending to displace the cover sides 1, 2 away from each other, will be somewhat further reduced and the portions 9, 10 will be pivoted somewhat from each other around the creasing lines 5, 6.

Figure 6:
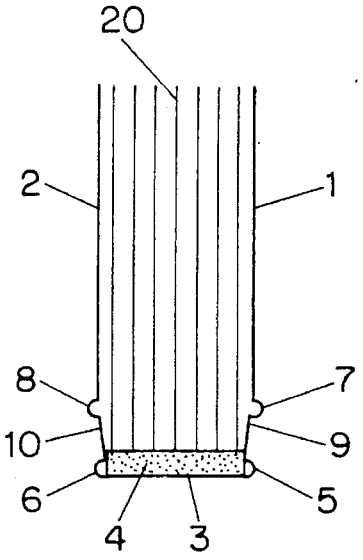
FIGS. 6 and 7 are schematic sectional views of the cover according to the invention during binding of a sheaf of papers into said cover.

FIG. 6 shows the cover 1–10 after it has been taken out of the package and a sheaf of papers 20 has been inserted between the cover sides 1, 2 which are kept together in parallel with a side edge of the sheaf of papers bearing against the strip 4.

Figure 7:
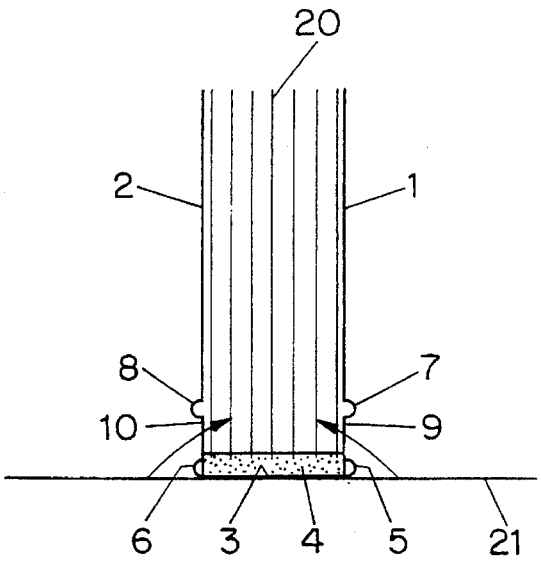

FIG. 7 shows the cover 1–10 containing a sheaf of papers 20 placed on a heating plate 21 which is part of a conventional binding machine, for instance, of the kind disclosed in U.S. Pat. No. 4,367,116. In this device, the cover sides 1, 2 are kept essentially parallel by means not shown in FIG. 7. On heating of the strip from the plate 21 via the spine 3, the strip will soften and will become more or less fluid such that the sheets of paper of the sheaf 20 will sink into the strip towards the spine. During said heating, the material in which the creasing lines 7 and 8 are made will also be heated. The softening of the strip 4 and the heating of the creasing lines 7, 8 cause the forces (although reduced) generated during the folding operation shown in FIG. 3, which forces tend to pivot the cover sides 1, 2 relative to the portions 9, 10, but have not been able to do so because the portions 9, 10 bear against the side edges 4*a*, 4*b* of the strip and because the cover sides are kept parallel, to be set free or released so that the portions 9, 10 will be pivoted around the creasing lines 5, 6 and 7, 8. The portions 9, 10 will thereby displace the outer portions of the soft strip 4 and will be pivoted towards each other around the creasing lines 5, 6, and the sheaf of papers 20 will be somewhat compressed by the portions and the cover sides 1, 2 or at least will be in contact with or at a short distance from the same.

Figure 8:
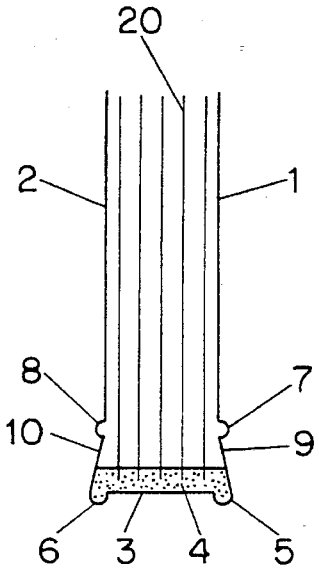
FIG. 8 is a schematic sectional view of a finished booklet made up of the cover according to the invention and a sheaf of papers bound into the same.

In FIG. 7 there is shown the shape of the cover 1–10 during heating of the strip 4 and the creasing lines 5—5, and the final shape of the cover on completion of the heating is shown in FIG. 8. FIG. 8 shows the finished booklet with the sheaf of papers 20 bound into the cover 1–10. It is evident from said figure that the lower side edges of the sheets of paper in the sheaf 20 are embedded in the strip 4 and that the portions 9 and 10 converge in a direction away from the strip 4.

While only one embodiment of the present invention has been described above and shown on the drawings, it will be understood that the invention is not limited to said embodiment but only by what is stated in the claims.

We claim:

1. A cover for a booklet comprising:

a spine, a strip of binding agent connected to and extending along the spine and adapted to be melted and subsequently cooled for binding a side edge of a sheaf of papers to the spine to form a booklet, the strip having side edges extending outward from the spine, two cover sides, means for connecting the cover sides to the spine including first and second pairs of creasing lines extending parallel to the strip, the first pair of creasing lines being positioned between the strip and the second pair of creasing lines and defining joint portions of the cover sides between the first and second pairs of creasing lines, the cover sides being foldable along the second pair of creasing lines in an opening direction and in a closing direction for opening and closing the booklet, and the second pair of creasing lines being deformed in opening direction and the first pair of creasing lines being deformed in the closing direction so that the cover sides and the joint portions form an acute angle relative the spine, whereby when the cover sides are brought together in the closing direction to thereby close the cover to form a booklet and the cover sides are essentially parallel, the deformation causes the joint portions to exert a force in the closing direction and inwardly of the booklet and bear against the side edges of the strip to prevent sheets from the sheaf of papers from falling between the strip of binding agent and the cover sides.

2. A cover according to claim 1, wherein the angle between the joint portions and the spine after the strip is melted and subsequently cooled, is less than the angle between the joint portions and the spine before the strip is melted.

3. A cover according to claim 2, wherein the angle between the joint portions and the spine after melting the strip is less than 90°.

4. A cover according to claim 1, wherein the joint portions bear against the outermost sheets of paper in a sheaf of papers inserted in the cover to form a booklet.

5. A method of manufacturing a booklet, wherein a cover of the booklet includes a spine having inner and outer surfaces, a strip of binding agent connected to and extending along the inner surface of the spine, two cover sides connected to side edges of the spine, and means for connecting the cover sides to the spine including first and second pairs of creasing lines extending parallel to the strip and foldable in an opening direction and in a closing direction for opening and closing the booklet, the first pair of creasing lines being positioned between the strip and the second pair of creasing lines and defining joint portions of the cover sides between the first and second pairs of creasing lines, comprising the steps of:

deforming the second pair of creasing lines in the opening direction and deforming the first pair of creasing lines in the closing direction so that the cover sides and the joint portions form an acute angle relative to the spine, folding the cover about the first and second creasing lines in the closing direction so that the cover sides essentially lie in parallel planes whereby, as a result of the deformation, the joint portions exert a force in the closing direction and inwardly of the booklet and bear against the side edges of the strip of binding agent by action of the inward force, heating the strip so that it is partially melted for causing the joint portions to pivot inwardly around the first pair of creasing lines and against the strip for binding a side edge of a sheaf of papers to the inner surface of the spine to form a booklet.

6. A method according to claim 5, wherein the steps of deforming the creasing lines and folding the cover sides are performed at about the same time.

7. A method according to claim 5, further comprising the step of heating the second pair of crease lines during the step of deforming the second pair of crease lines.

8. A method according to claim 5, wherein when the strip is heated the joint portions pivot inwardly at an angle of less than 90° relative to the spine.

9. A method according to claim 5, wherein when the joint portions pivot inwardly upon heating of the strip, the joint portions exert an inward force against the outermost sheets of paper in the sheaf of paper inserted to form a booklet.

10. A device for manufacturing a cover for a booklet, wherein the cover includes a spine having inner and outer surfaces, a strip of binding agent connected to and extending along the inner surface of the spine for binding a side edge of a sheaf of papers to the inner surface of the spine to form the booklet, two cover sides connected to side edges of the spine, and means for connecting the cover sides to the spine including first and second pairs of creasing lines extending parallel to the strip, the first pair of creasing lines being positioned between the strip and the second pair of creasing lines and defining joint portions of the cover sides between the first and second pairs of creasing lines, the cover sides being foldable along the second pair of creasing lines in an opening and in a closing direction for opening and closing the booklet comprising:

a matrix and folding elements movable relative to the matrix, whereby the folding elements deform the second pair of creasing lines in the opening direction such that the joint portions exert a force in the closing direction and inwardly of the booklet, pivot inwardly about the first pair of creasing lines by action of the inward force and bear against the strip of binding agent by action of the inward force when the cover sides are folded in parallel relation to form a booklet.

11. A device according to claim 10, wherein the folding elements fold the joint portions in the closing direction and inwardly around the first pair of creasing lines.

12. A device according to claim 10, wherein the matrix comprises essentially acute triangular recesses, and the folding elements comprise triangular edges for forcing the second pair of creasing lines into the recesses of the matrix.

13. A device according to claim 10, wherein the matrix comprises a protrusion against which the strip bears during folding.

* * * * *